US006040661A

United States Patent [19]

Bogdan

[11] Patent Number: 6,040,661

[45] Date of Patent: Mar. 21, 2000

[54] PROGRAMMABLE UNIVERSAL LIGHTING SYSTEM

[75] Inventor: Alexei Bogdan, Bolton, Canada

[73] Assignee: Lumion Corporation, Ontario, Canada

[21] Appl. No.: 09/075,841

[22] Filed: May 12, 1998

Related U.S. Application Data

[60] Provisional application No. 60/076,688, Feb. 27, 1998.

[51] Int. Cl.[7] ..... H05B 37/02

[52] U.S. Cl. ..... 315/224; 315/291; 315/DIG. 4

[58] Field of Search ..... 315/244, 307, 315/291, 219, 200 R, 224, DIG. 4, DIG. 5

[56] References Cited

U.S. PATENT DOCUMENTS

| | | | |
|---|---|---|---|
| 3,648,106 | 3/1972 | Engel et al. | 315/291 |
| 4,277,728 | 7/1981 | Stevens | 315/307 |
| 4,701,673 | 10/1987 | Lagree et al. | 315/244 |
| 4,717,863 | 1/1988 | Zeiler | 315/307 |
| 4,727,297 | 2/1988 | Wolze | 315/307 |
| 4,894,587 | 1/1990 | Jungreis et al. | 315/200 R |
| 5,039,921 | 8/1991 | Kakitani | 315/307 |
| 5,099,178 | 3/1992 | Bozzer et al. | 315/169.1 |
| 5,287,040 | 2/1994 | Lestician | 315/291 |
| 5,323,090 | 6/1994 | Lestician | 315/291 |
| 5,363,020 | 11/1994 | Chen et al. | 315/209 R |
| 5,365,151 | 11/1994 | Spiegel et al. | 315/209 |
| 5,371,444 | 12/1994 | Griffin | 315/291 |
| 5,394,064 | 2/1995 | Ranganath et al. | 315/209 |
| 5,502,635 | 3/1996 | Bobel | 363/132 |
| 5,569,984 | 10/1996 | Holtslag | 315/307 |
| 5,583,402 | 12/1996 | Moisin et al. | 315/307 |
| 5,677,602 | 10/1997 | Paul et al. | 315/224 |
| 5,680,015 | 10/1997 | Bernitz et al. | 315/291 |
| 5,729,097 | 3/1998 | Holzer | 315/307 |
| 5,747,942 | 5/1998 | Ranganath | 315/224 |

FOREIGN PATENT DOCUMENTS 1225430 11/1987 Canada .

*Primary Examiner*—David H. Vu
*Attorney, Agent, or Firm*—McDermott, Will & Emery

[57] ABSTRACT

A programmable universal ballast can be programmed to accommodate a gas discharge lamp within a relatively wide wattage range. The ballast uses a microprocessor to store and execute various routines to start, run and dim a particular lamp type. A host computer produces customized routines which are downloaded into a microprocessor located within the ballast. These routines output signals to the MOSFET transistors of the inverter which effect dynamic and selective changes in the duty cycle and the frequency of the inverter signal. By selectively changing simultaneously both the frequency and duty cycle of the inverter signal, the energy spectrum of the resonance network is altered and circuit voltages and currents can be controlled to accurately match required lamp characteristics and operational requirements. The ballast may include an inductive element in parallel with the lamp allowing dimming to 1% of full light output. The use of this inductive element also results in a simplified and reliable lamp starting procedure and power factor correction.

16 Claims, 7 Drawing Sheets

| FREQ. | $V_R$ | $V_F$ | FREQ. | $V_R$ | $V_F$ | FREQ. | $V_R$ | $V_F$ |
|---|---|---|---|---|---|---|---|---|
| 20 | 0.4165 | 6.73 | 30 | 0.4103 | 6.98 | 39 | 0.3873 | 6.93 |
| 21 | 0.4191 | 6.81 | 31 | 0.4085 | 6.99 | 40 | 0.3855 | 6.94 |
| 22 | 0.4207 | 6.86 | 32 | 0.4065 | 6.99 | 41 | 0.3839 | 6.95 |
| 23 | 0.4209 | 6.90 | 33 | 0.4098 | 6.96 | 42 | 0.3813 | 6.96 |
| 24 | 0.4196 | 6.91 | 34 | 0.3985 | 6.92 | 43 | 0.3791 | 6.96 |
| 25 | 0.4175 | 6.91 | 35 | 0.3947 | 6.90 | 44 | 0.3768 | 6.96 |
| 26 | 0.4155 | 6.91 | 36 | 0.3930 | 6.90 | 45 | 0.3744 | 6.96 |
| 27 | 0.4142 | 6.93 | 37 | 0.3910 | 6.91 | 46 | 0.3724 | 6.97 |
| 28 | 0.4129 | 6.95 | 38 | 0.3895 | 6.92 | 47 | 0.3698 | 6.97 |
| 29 | 0.4118 | 6.96 | | | | | | |
FIG. 4A
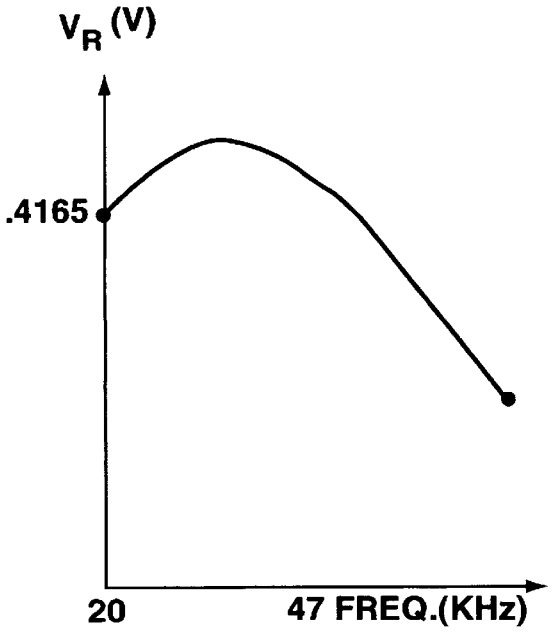
FIG. 4B
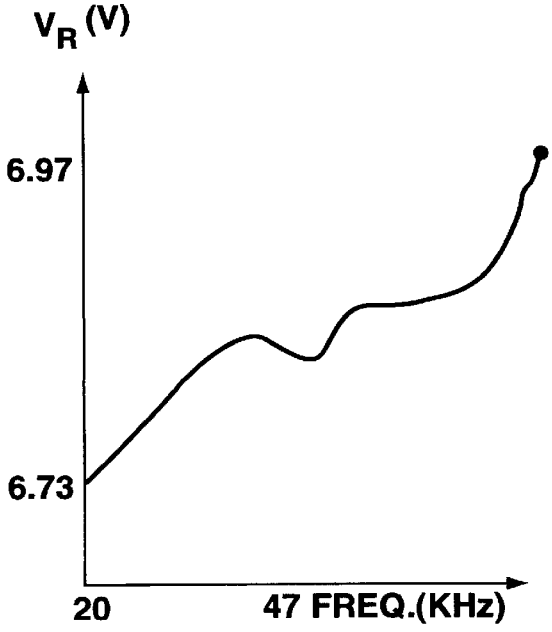
FIG. 4C

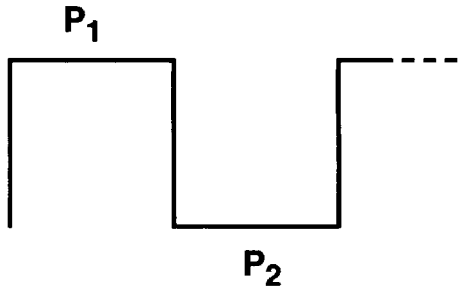
FIG. 5A
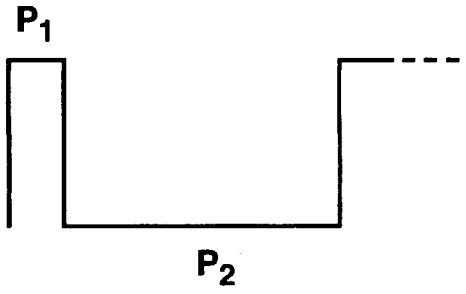
FIG. 5B
| Duty Cycle | $V_R$ | $V_F$ |
|---|---|---|
| 50/50 | 0.4179 | 6.73 |
| 46/54 | 0.4165 | 6.72 |
| 42/58 | 0.4117 | 6.66 |
| 38/62 | 0.4063 | 6.52 |
| 34/66 | 0.3971 | 6.42 |
| 30/70 | 0.3769 | 6.28 |
| 26/74 | 0.3627 | 6.08 |
| 22/78 | 0.3342 | 5.75 |
| 18/82 | 0.3142 | 5.37 |
| 14/86 | 0.2673 | 4.98 |
| 10/90 | 0.2120 | 4.34 |
| 6/94 | 0.1500 | 3.05 |
| 2/98 | 0.0950 | 1.92 |
FIG. 6A
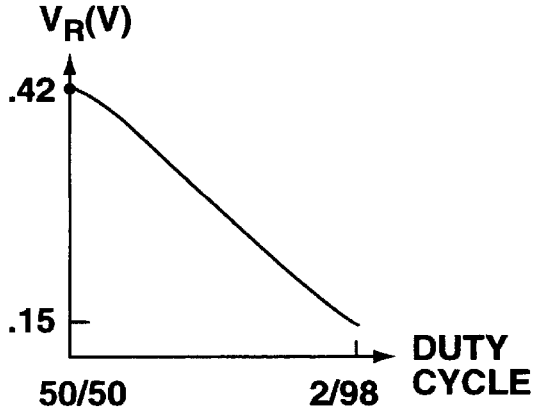
FIG. 6B
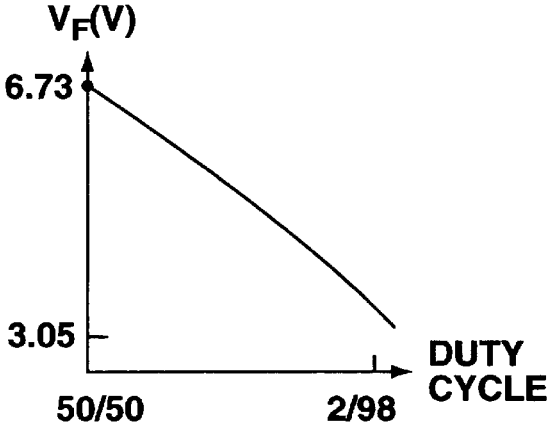
FIG. 6C

PROGRAMMABLE UNIVERSAL LIGHTING SYSTEM

This application claims benefit from U.S. provisional application Ser. No. 60/076,688 filed Feb. 27, 1998.

FIELD OF THE INVENTION

The present invention relates generally to lighting ballasts and in particular to a universal ballast which can accommodate a wide range of gas discharge lamp types.

BACKGROUND OF THE INVENTION

The lighting industry has been witness to an explosion of the number of types of commercially available fluorescent lamps. Whereas twenty years ago there were between 40 and 45 lamps available, today there are over 300 different types of fluorescent lamps available on the market. Each type of fluorescent lamp has its own set of uniquely rated characteristics, such as running voltage and filament impedance. In order to properly start, run and dim a lamp, these characteristics must be carefully taken into account. Accordingly, lamp characteristics must be painstakingly matched with the appropriate ballast to avoid lamp failure.

While it is easy to physically replace one fluorescent lamp with another fluorescent lamp of a lower wattage (for example the T12 with a T8) or of a different type but with the same or similar wattage (for example the T8-18W and the PLC-18W), simply doing so can cause serious problems. First, since every ballast design is optimized for a particular lamp with a particular set of characteristics, a lamp of a lower wattage will not usually start reliably in a ballast designed for a higher wattage lamp. Second, operating characteristics such as filament impedance and the lamp current are normally substantially different for different lamp types, which will result in asymmetric and distorted lamp voltage and current waveforms causing considerable lamp flicker. Finally, the different operating characteristics of a lower wattage lamp, for example, can cause a larger rms current to be drawn from the ballast. This results in lamp current easily exceeding the rated ballast load current and leads to early ballast failure.

As a result, ballast manufacturers are forced to carry increasing inventories of ballast types as lamp manufactures continue to develop new lamp types. It is common industry practice for ballast manufacturers to routinely stock hundreds of different ballast configurations in order to comply with the conditions of lamp warranties. Further, the production cycle and the full market value of a new fluorescent lamp technology is dependent on the presence of a corresponding ballast, built to accommodate the new lamp's operating characteristics. Delays in the production of lamp-specific ballast equipment causes systemic market and production inefficiencies which are not easily resolved even through strategic planning or industry cooperation.

Accordingly, it has been the aim of many ballast designers to design a ballast which can accommodate various types of gas discharge lamps without the need to physically alter the ballast's hardware configuration.

Ballast designers have designed adaptor circuits which can be used to retrofit ballasts so that one type of lamp can be safely replaced by another. U.S. Pat. No. 4,701,673 to Lagree et al. discloses such a device which converts a conventional two lamp rapid start T12 ballast into a ballast that will operate two T8 fluorescent lamps. The adaptor circuit comprises an auxiliary circuit including a tuned series-parallel LC network connected in parallel with one or both of the lamps and tuned to supply an odd harmonic current to the lamps. While such a solution allows two different types of lamps to be accommodated by a particular hardwired ballast, such devices can only offer modest retrofitting capability as they can only accommodate a small number of lamp types and require the installation of external circuitry.

Another approach has been to design ballasts that provide variable current to a lamp by varying the frequency of the inverter circuit. U.S. Pat. No. 5,287,040 to Lestician describes such a ballast which uses isolation transformers, operating in their "high frequency zone" to feed power to one or more fluorescent lamps. An increase in frequency (with voltage held constant) will cause a decrease in output current and thus by appropriately setting the nominal operation frequency of the transformer, different lamp sizes can be accommodated without rewiring or changing components.

The range of lamps which can be accommodated using this technique is limited due to the fact that the inverter frequency must be confined within the range of 20 and 55 KHz to meet FCC ballast operational standards. This range is further limited due to informal industry recommendations that inverter frequencies not exceed 47 KHz in order to avoid interference with television remote control devices. Further, the frequency of the pulse signal used to drive the circuit cannot fall below a critical threshold frequency i.e., the loaded resonant frequency. Below this threshold, the circuit begins to oscillate in a "capacitive" mode, leading to destruction of circuit components. In addition, circuit components do not exhibit optimal performance throughout the range of frequencies that may be needed for control.

Finally, some ballast designers have used microcontrollers to adjust lamp current according to stored lamp loading data as in U.S. Pat. No. 5,039,921 to Kakitani which adjusts the frequency of the inverter to change lamp voltage. Again, while this invention provides for the adaption of the ballast to various types of gas discharge lamps, the range of lamps which can be accommodated using frequency control is limited due to allowable frequency range which may be used and other circuit performance factors. Further, other critical operational factors, such as starting and dimming are not contemplated.

Another ballast design dealing with dimming is exemplified by U.S. Pat. No. 5,583,402 to Moisin et al. which describes an inverter control circuit that is used to adjust the duty cycle or frequency of an inverter signal to change the level of current flowing through the lamp. The lamp is connected into a resonant circuit, tuned such that a change in the duty cycle of the AC signal changes the level of current flowing through the load. However, due to the low Q factor of the resonant circuit, the change in frequency only has a minor effect on the dimming of the lamp. Further, this inverter control circuit is directed to providing variable current to a lamp for dimming, without regard to other factors critical to the operation of a lamp, such as running or starting conditions.

For a ballast to have practical universal application to a wide range of lamp types, it must be able to appropriately start, run and dim a lamp according to that lamp's particular characteristics. It is also desirable for such a ballast to provide superior starting and dimming functionality using cost effective components.

Starting circuits are often unreliable due to various environmental conditions such as static discharge. Further most lamp striking circuits do not comply with long established ANSI standards. Dimming circuits for use with gas discharge lamps are typically complex, requiring a high number of components and making them expensive to build, install and retrofit to existing ballasts. Further, most prior art fluorescent dimmers can only achieve dimming rates for compact fluorescent lamps of approximately 25% and approximately 10% for linear fluorescent lamps using variable frequency methods. While some manufacturers have attempted to improve the dimming range by changing the duty cycle of the inverter signal, these methods are notoriously unreliable as they often result in a loss of the plasma thread causing the lamp to extinguish. It is believed that this occurs because the capacitance conventionally connected across the lamp passes the high frequency harmonics which comprise much of the energy in a low duty cycle signal, thereby shorting the lamp.

Thus, there is a need for a universal lighting ballast which is suited to operate a wide range of different fluorescent lamp types, and which can offer improved dimming and starting functionality on a cost effective basis.

BRIEF SUMMARY OF THE INVENTION

It is therefore an object of the present invention to provide a universal ballast for powering any one of a plurality of gas discharge lamp types, each lamp type having a predetermined set of lamp characteristics, said universal ballast comprising:

(a) a power circuit for outputting a high frequency AC signal;

(b) a coupling circuit coupled to the power circuit for applying the AC signal to the lamp; and (c) a control circuit for varying the duty cycle and the frequency of the AC signal in accordance with the set of lamp characteristics.

In a second aspect, the present invention provides a method of powering any one of a plurality of gas discharge lamp types, each lamp type having a predetermined set of lamp characteristics, said method comprising the steps of:

(a) producing a high frequency AC signal;

(b) applying the AC signal to the lamp; and (c) varying the duty cycle and the frequency of the AC signal in accordance with the set of lamp characteristics.

It is also an object of the present invention to provide a method of dimming a gas discharge lamp, comprising:

(a) establishing an inductance across the lamp;

(b) producing a high frequency AC signal;

(c) applying the AC signal to the lamp;

(d) varying the duty cycle and the frequency of the AC signal to dim the lamp.

Further objects and advantages of the invention will appear from the following description, taken together with the accompanying drawings.

BRIEF DESCRIPTION OF THE DRAWINGS

In the accompanying drawings:

FIG. 4A is a table listing lamp running voltage $V_R$ and lamp filament voltage $V_F$ for various values of signal frequency for the resonance circuit of FIG. 3;

FIG. 4B is a graph showing lamp running voltage $V_R$ versus signal frequency for the resonance circuit of FIG. 3;

FIG. 4C is a graph showing lamp filament voltage $V_F$ versus signal frequency for the resonance circuit of FIG. 3;

FIG. 5A is a graph showing a duty cycle of 50 percent;

FIG. 5B is a graph showing a duty cycle of less than 50 percent;

FIG. 6A is a table listing lamp running voltage $V_R$ and lamp filament voltage $V_F$ for various values of signal duty cycle for the resonance circuit of FIG. 3;

FIG. 6B is a graph showing lamp running voltage $V_R$ versus signal duty cycle for the resonance circuit of FIG. 3;

FIG. 6C is a graph showing lamp filament voltage $V_F$ versus signal duty cycle for the resonance circuit of FIG. 3;

DETAILED DESCRIPTION OF PREFERRED EMBODIMENTS

Figure 1:
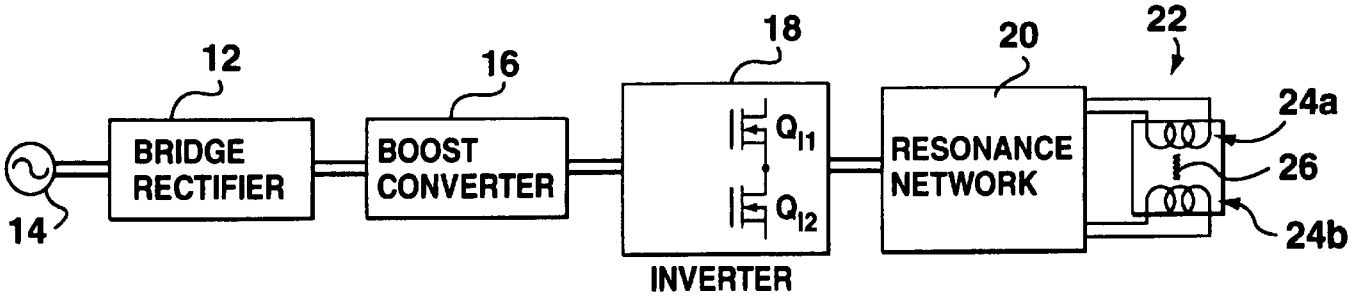
FIG. 1 (PRIOR ART)
FIG. 1 is a block diagram of a typical prior art electronic lighting ballast.

Reference is first made to FIG. 1, which shows a well known prior art electronic ballast 10. Ballast 10 includes a rectifier 12, fed from a conventional AC supply 14, and coupled to a boost converter 16. AC supply 14 is a predetermined rated AC power, such as 220 volts 50 Hz or 120 volts 60 Hz. Boost converter 16 is used to provide regulated voltage to an inverter 18. Inverter 18 is used to convert the input DC voltage received from boost converter 16 into a high frequency AC voltage and typically includes MOSFET transistors $Q_{I1}$ and $Q_{I2}$ at its output, although many other implementations are possible (i.e. using bipolar transistors). The high frequency signal generated by transistors $Q_{I1}$ and $Q_{I2}$ is applied to a resonance network 20. Resonance network 20 is directly coupled to lamp 22 and is commonly used to avoid the necessity of an output transformer.

Lamp 22 includes two filaments 24*a* and 24*b* which must be preheated in order to enable gas 26 to enter into a plasma state such that a plasma "thread" is produced within lamp 22. In order to maintain this plasma thread, sufficient voltage or current must be maintained across lamp 22. If either the current or voltage is interrupted, the plasma thread will break and lamp 22 will extinguish.

Figure 2:
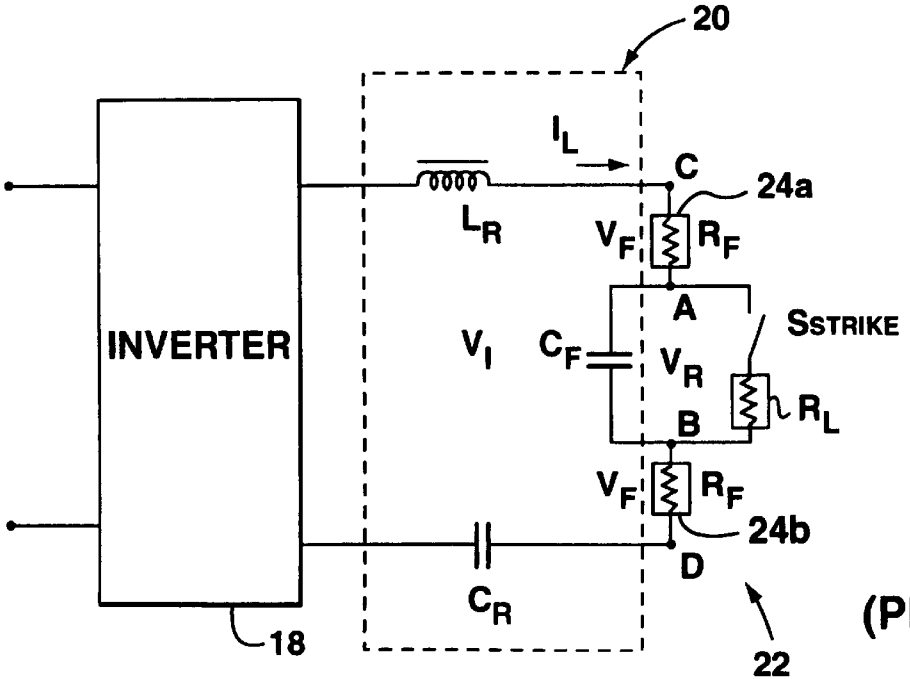
FIG. 2 (PRIOR ART)
FIG. 2 is a more detailed schematic view of an equivalent circuit for the resonance circuit and lamp of FIG. 1.

FIG. 2 shows the basic configuration of a typical fluorescent lamp 22 connected to a typical resonance network 20 which is in turn connected to inverter 18. Lamp filaments 24*a* and 24*b* can be each represented by an equivalent filament impedance $R_F$ and the electrical properties of gas 26 can be represented by an equivalent lamp impedance $R_L$ and an equivalent switch $S_{STRIKE}$. An unstruck lamp 22 is represented by an "open" equivalent switch $S_{STRIKE}$. When lamp 22 is struck, plasma will start to flow in lamp 22 and switch $S_{STRIKE}$ will be "closed" such that impedance $R_L$ forms part of the circuit. Using this fundamental circuit model, the operation of lamp 22 in a typical electronic ballast 10 can be understood.

Resonance network 20 includes an inductor $L_R$ in series with lamp 22, which is conventionally used to limit the current flowing in lamp 22. Inductor $L_R$ is also used to maintain operation of lamp 22. Since the presence of inductor $L_R$ results in a phase shift between the voltage and current signals associated with resonance network 20, current will flow through the lamp when the voltage is zero, and voltage will exist across the lamp when the current is zero. In this way, inductor $L_R$ ensures that the plasma thread of gas 26 does not break.

Resonance network 20 also includes capacitor $C_R$ which is used to block large DC voltage spikes within ballast 10. As a result, the switching transistors of inverter 18 operate on a substantially symmetrical square wave voltage having essentially no DC component and provide a substantially sinusoidal AC current to lamp 22. Since most ballasts 10 are operated above the resonance frequency or in the "inductive slope" area of the resonance curve, attendant high frequency harmonics will be absorbed by resonance network 20 and inverter 18 is guaranteed to be free from voltage spikes.

Resonance network 20 also includes a capacitor $C_F$ which is typically connected across lamp 22 to ensure continuous current flows through filaments 24*a* and 24*b*. Specifically, when zero voltage is present across lamp 22, capacitor $C_F$ will supply local current to lamp 22. Since current continuously flows through filament 24*a*, capacitor $C_F$ and filament 24*b*, filaments 24*a* and 24*b* will be preheated before the lamp strikes.

In order for lamp 22 to be properly driven, ballast 10 must be able to produce certain voltage and current characteristics suited to the lamp's particular characteristics. When lamp 22 has been struck and is in full operation, the running voltage $V_R$ measured between nodes A and B must be within its manufacturer's specified range. Typically, ballast 10 would be designed to provide a voltage between 35 and 130 volts (rms) for running operation of lamp 22. Further, particular voltages must be provided across filaments 24*a* (between nodes C and A) and 24*b* (between nodes B and D) during the course of lamp operation. This voltage is the filament voltage $V_F$. The current flowing through lamp 22 or current $I_L$ must also be such that lamp 22 can be safely run. Finally, a sufficient striking (or ignition) voltage $V_I$ must be applied between nodes A and B while switch $S^{STRIKE}$ is open, such that gas 26 ignites into plasma form and forms a plasma thread.

In view of the above, ballast designers design specific ballasts to accommodate the running voltage $V_R$, filament voltage $V_F$, lamp current $I_L$ and striking voltage $V_I$ of individual lamps. Values of capacitors $C_R$ and $C_F$ and inductor $L_R$ are chosen so that they can withstand circuit variants and provide the appropriate current and voltage to lamp 22. It should be noted that by changing the frequency of oscillation within the fairly narrow range of 20 to 47 KHz, it is only possible to approximately double (or halve) circuit inductance and halve (or double) circuit capacitance of resonance network 20.

Ballast designers choose an optimal inverter frequency and optimal values of circuit inductance and capacitance to create proper currents and voltages across the lamp as well as to produce an economical ballast configuration. When designing inverter 18, the designer will first choose the input DC voltage delivered by boost converter 16, typically within the range of 300 to 600 volts. Then values of frequency, capacitance and inductors are chosen to suit the specific lamp.

The differences between lamp types can be practically illustrated by considering the rated specifications for two commonly used 18 watt lamps, the T8-18W and the PLC-18W. While these lamps are of the same wattage, the rated voltage and resistance characteristics are substantially different. It should be noted that for a particular lamp type, filament voltage $V_F$ is approximately linearly related to filament resistance $R_F$. It is common for lamp characteristics to be expressed in terms of running voltage $V_R$ and filament resistance $R_F$. For example, the rated running voltage $V_R$ and filament resistance $R_F$ of a T8-18W lamp are 130 volts and 4.7 ohms, respectively. In contrast, the rated running voltage $V_R$ and filament resistance $R_F$ of a PLC-18W lamp are 37 volts and 1.2 ohms, respectively. The percentage difference between the two rated running voltages $V_R$ is 77% and the percentage difference between the two rated filament resistances $R_F$ is 75%. Thus, in order to accommodate both these lamps, ballast 10 would have to achieve a comparable percentage difference of running lamp voltage $V_R$ and filament voltage $V_F$.

Figure 3:
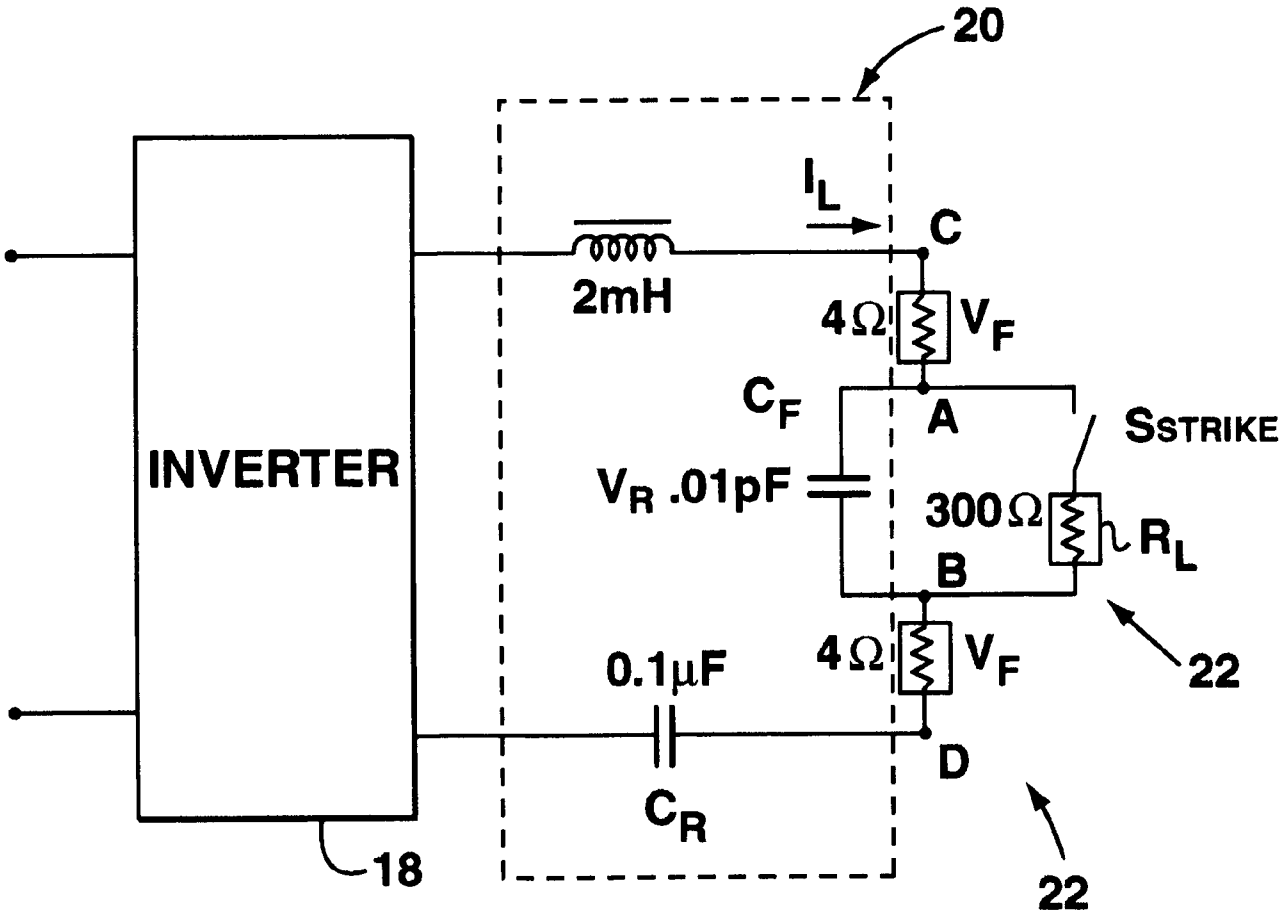
FIG. 3 (PRIOR ART)
FIG. 3 is a schematic diagram showing typical values for the resonance circuit of FIG. 2.

Reference is next made to FIG. 3 which shows the circuit of FIG. 2 having typical component values. Accordingly, in the example of FIG. 3 inverter 18 is set to operate at approximately 25 KHz, lamp 22 will have an impedance of approximately 300 ohms and the filament resistance will be approximately 4 ohms. Further, resonance inductance $L_R$ is 2 mH, capacitance $C_F$ is 0.01 pF and resonance capacitance $C_R$ is 0.1 $\mu$F.

The inventor has determined by experimentation that when the frequency of resonant circuit 20 of FIG. 3 is increased through the range 20 KHz to 47 KHz, the overall percentage change in running voltage $V_R$ is approximately 13.3% and the overall percentage change in the filament voltage $V_F$ is approximately 3.5%. These changes in lamp voltage characteristics are due to the fact that when the frequency of inverter 18 is increased from 20 KHz to 47 KHz, the voltage drop across inductor $L_R$ increases and the inductive character of resonance network 20 increases. The current through capacitor $C_F$ also increases with frequency since its impedance decreases at higher frequencies. These changes result in a decreased running voltage $V_R$ and an increased filament voltage $V_F$. FIG. 4A shows the detailed results of this experiment in tabular form and FIGS. 4B and 4C show the results in graphical form.

Nonetheless, the percentage change in lamp characteristics (voltage) can only be influenced over the recommended frequency range of 20 to 47 KHz. Specifically, experimentation indicates that running voltage $V_R$ can only be changed by a maximum of 12% and filament voltage $V_F$ can only be changed by up to 3.5% within a frequency range of 20 KHz to 47 KHz. In contrast, the percentage difference between the rated running voltage $V_R$ of the respective T8-18W and PLC-18W lamps is 77% and the percentage difference between the rated filament resistance $R_F$ for these lamps is 75%. Accordingly, it would not be possible for ballast 10 to accommodate both T8-18W and PLC-18W lamps simply by adjusting the frequency of inverter 18 within the allowable range.

However, the inventor has determined by further experimentation with the circuit of FIG. 3 that when the frequency of inverter 18 is frozen and duty cycle of inverter 18 is decreased from a 50/50 ratio down to a 2/98 ratio, the overall percentage change in the running voltage $V_R$ is approximately 64.1% while the overall percentage change in the filament voltage $V_F$ is approximately 54.7%. FIG. 5A shows a uniform square wave oscillation having duty cycle 50/50 which is applied to the output transistors of inverter 18. FIG. 5B shows an altered oscillation having a reduced duty cycle where $P_1$ represents the pulse width of the first pulse and $P_2$ represents the pulse width of the second pulse and the duty cycle is the ratio of $P_1$ to $P_2$. It should be noted that since the sum $P_1+P_2$ remains constant, the frequency of the oscillation signal applied to inverter 18 remains constant. FIG. 6A shows the detailed results of this experiment in tabular form and FIGS. 6B and 6C show the results in graphical form.

Since the duty cycle of the oscillation signal being applied to the inverter 18 is being altered (i.e. by modifying the width of each pulse), the energy of the first harmonic of the signal is being changed. However, since the frequency is held constant the frequencies of the harmonics are not altered. In this way it is possible to change the energetic split between the voltages and current produced in resonance network 20. Further, since inverter 18 effectively acts as a large filter, when the duty cycle is changed all high harmonics are filtered out and high frequency pollution is avoided.

Accordingly, increasing the oscillation frequency increases the filament voltage $V_F$ and decreases the running voltage $V_R$ and decreasing the duty cycle reduces both the filament voltage $V_F$ and running voltage $V_R$. For the circuit of FIG. 3, it was experimentally determined that the maximum range of running voltage $V_R$ which can be influenced by changing duty cycle is 13.3% and the maximum range due to frequency change is 64.1%. Since these effects are linearly additive, it is possible to use combinations of changes in duty cycle and frequency to achieve a total percentage difference in running voltage $V_R$ of 77.4%. Since there are two independent means of adjusting voltages and currents within resonance network 20, by independently tuning duty cycle and frequency of the oscillation signal, it is possible to accommodate a substantially wide range of lamp types for a particular hardware configuration.

Figure 7:
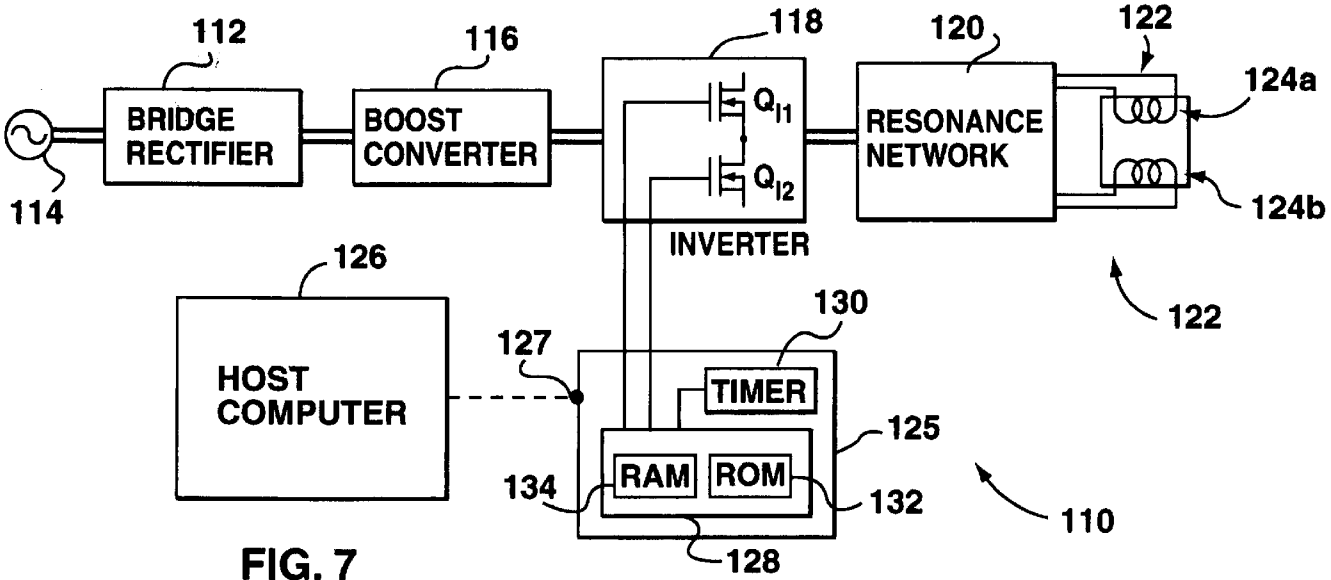
FIG. 7 is a diagrammatic view of a universal electronic lighting ballast, according to the present invention.

Reference is next made to FIG. 7, which shows a universal ballast 110 according to a preferred embodiment of the invention. Ballast 110 has been designed to allow a user to download relevant information in order to appropriately start, run and dim a particular lamp type. Common elements between the universal ballast 110 and the prior art ballast 10 will be denoted by the same numerals with one hundred added thereto.

Accordingly, universal ballast 110 includes a rectifier 112, fed from a supply voltage source 114 and connected to a boost converter 116. Boost converter 116 is connected to an inverter 118 which is in turn connected to a resonance network 120. Inverter 118 includes MOSFET transistors $Q_{I1}$ and $Q_{I2}$ at its output. Resonance network 120 is configured as a typical series resonant circuit which ignites and controls a lamp 122 with filaments 124*a* and 124*b*. Universal ballast 110 further includes a controller 125 which controls the frequency and duty cycle of the ballast oscillation signal by controlling the operation of transistors $Q_{I1}$ and $Q_{I2}$ of inverter 118. Controller 125 is located within the casing of universal ballast 110 and is designed to receive information from an external host computer 126 through a ballast port 127.

Rectifier 112, boost converter 116 and inverter 118 are all identical to their prior art equivalents, namely rectifier 12, boost converter 16 and inverter 18. While the present invention will still operate if resonant network 120 is identical to prior art resonant network 20, additional functionality can be achieved (see FIG. 8) by replacing capacitor $C_F$ with inductors $L_{F1}$, $L_L$ and $L_{F2}$, configured as shown, and having a total reactance equivalent to that of capacitor $C_F$. Inductor $L_{F1}$ is connected across nodes C and A, inductor $L_{F2}$ is connected across nodes B and D, and inductor $L_L$ is connected across nodes A and B. Inductors $L_{F1}$, $L_{F2}$ and $L_L$ can either be independent inductors or wound on the same core. It should be noted that if the inductors are implemented on a single core, the polarity of the windings is immaterial to the operation of the circuit. As frequency is increased, the frequency response of resonance network 120 will have a greater inductive character resulting in reduced lamp current $I_L$ (i.e. filament voltage $V_F$ will decrease). This creates a lagging power factor in lamp 22. In contrast, when frequency is decreased within prior art resonance network 20, lamp current $I_L$ will increase (i.e. filament voltage $V_F$ will increase).

As discussed, a particular set of lamp characteristics can be produced within universal ballast 110 by appropriately varying the frequency and the duty cycle of operation of inverter 118. This can be achieved by controlling the operation of transistors $Q_{I1}$ and $Q_{I2}$ of inverter 118. Controller 125 utilizes a microprocessor 128 and a timer 130 to change the operating oscillation frequency and/or duty cycle of the power of a typical electronic ballast. Specifically, controller 125 provides a variable square wave output to drive transistors $Q_{I1}$ and $Q_{I2}$ of inverter 118 to change the frequency of operation of inverter 118. By varying the frequency and/or the duty cycle of the square wave output (as shown in FIG. 5A) of controller 125, the operational frequency and/or duty cycle of inverter 118 is suitably affected.

Microprocessor 128 may be any commercially available programmable device such as a Motorola 6800 processor, although it should be understood that any type of appropriate logic circuit with a memory can be used. Storage of program instructions and other static data is provided by a read only memory (ROM) 132, while storage of dynamic data is provided by a random access memory (RAM) 134. Both memory units 132 and 134 are controlled and accessed by microprocessor 128. Microprocessor 128 may have a "self erasing" feature which erases software held in RAM 134 upon receiving a signal from controller 125 that ballast 110 has been tampered with. At that point the user must return universal ballast 110 to the manufacturer in order to return microprocessor 128 back to its normal operating state. Timer 130 is a widely used Model 555 timer which utilizes an RC oscillator to produce a constant timing frequency signal. An applied reference signal produces a first polarity output. An opposite polarity output is produced at a time thereafter determined by an applied DC level.

Accordingly, when it is determined that a particular lamp is to be accommodated by universal ballast 110, application software is run on host computer 126 to determine what kind of program ballast 110 should be running. This program will be formatted to run on microprocessor 128 and will allow controller 125 to determine the proper set and sequence of frequencies and duty cycles which will result in proper lamp starting, running and dimming. Accordingly, the program will contain routines specific to these various functions and customized for the particular lamp at issue. Once this program has been prepared, host computer 126 will download it through a conventional RS-232 interface to port 127 on ballast 110. Port 127 is coupled to microprocessor 128, such that the program can be delivered to and stored in RAM 134 where it will be ready for execution.

At this point, normal operation of ballast 110 may begin, and the proper striking, running and dimming routines will execute as required. When the user presses the appropriate button for striking, microprocessor 128 will call the starting routine. The start routine will cause an appropriate variation in oscillation signal duty cycle and frequency, depending on the starting circuitry used within ballast 110, to strike lamp 22 as will be described. Once lamp 22 has been successfully struck, the running routine will execute to maintain lamp 22 in proper running condition. Finally, when the user presses the appropriate button for dimming, microprocessor 128 will call the dimming routine which can implement a variety of dimming protocols by suitably changing the oscillator signal duty cycle as will be described.

Figure 9A:
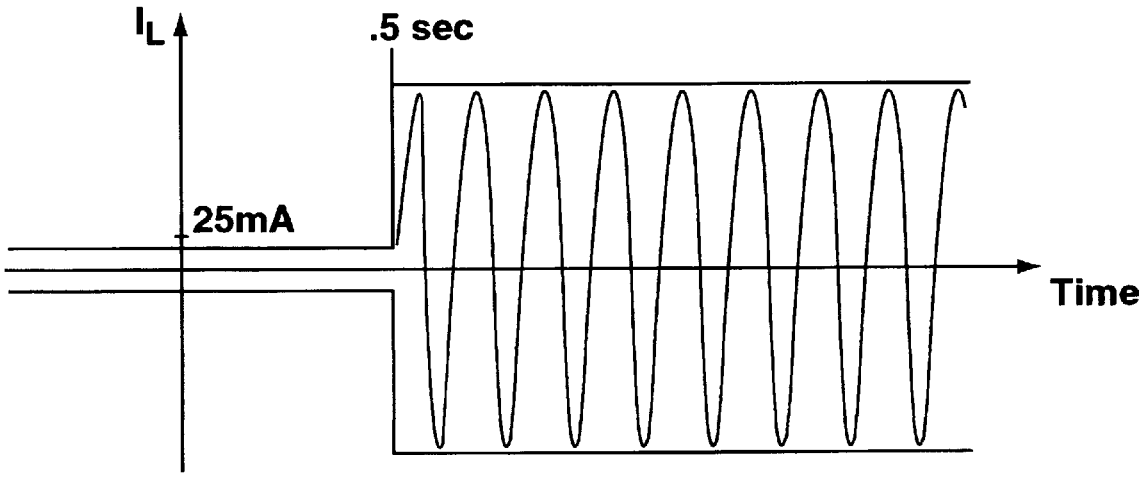
FIG. 9A is a graph showing ANSI standard lamp striking requirements for lamp current $I_L$.
Figure 9B:
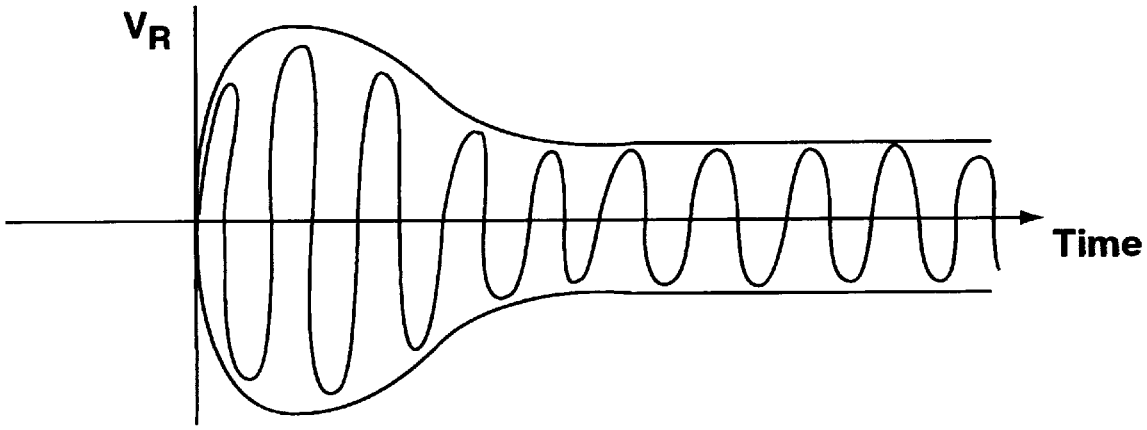
FIG. 9B is a graph showing ANSI standard lamp striking requirements for lamp striking voltage $V_I$.

Universal ballast 110 of FIG. 7 with or without additional circuitry can achieve striking conditions that conform to the well known ANSI standards. FIGS. 9A and 9B illustrate the ANSI standard requirements for lamp current $I_L$ and lamp striking voltage $V_I$ respectively. As shown, these specifications require that for at least 0.5 seconds (but not for longer than 1 second) filament voltage $V_F$ be used to preheat the filaments. During this period of time, lamp current $I_L$ may not exceed 25 mA. After 0.5 seconds (but before 1 second has elapsed) a stable current must flow through lamp 22. Further, the ANSI standard requires that filament voltage $V_F$ consistently decline after the 0.5 second interval so as not to consume excessive energy in the filaments.

Some commercially available ballast starters use a Positive Temperature Condition Resistant (PTC) element in parallel with capacitor $C_F$ of the typical ballast 10 of FIG. 2. However, this configuration does not consistently meet the ANSI standards due to environmental factors such as static discharge which inhibit the production of high energy spikes required for striking.

A superior approach can be adopted simply using the bare circuitry of the present invention. Specifically, controller 125 can be programmed to execute a start routine which will increase the frequency of the inverter 118 signal for the first 0.5 seconds. As a result, a high filament voltage $V_F$ will be applied to preheat filaments 124*a* and 124*b* and a low lamp voltage $V_L$ will be applied to the gas of lamp 22. After 0.5 seconds has passed, controller 125 will instantaneously change the duty cycle and frequency of inverter 118 signal such that striking voltage $V_I$ is applied to lamp 22.

Figure 8:
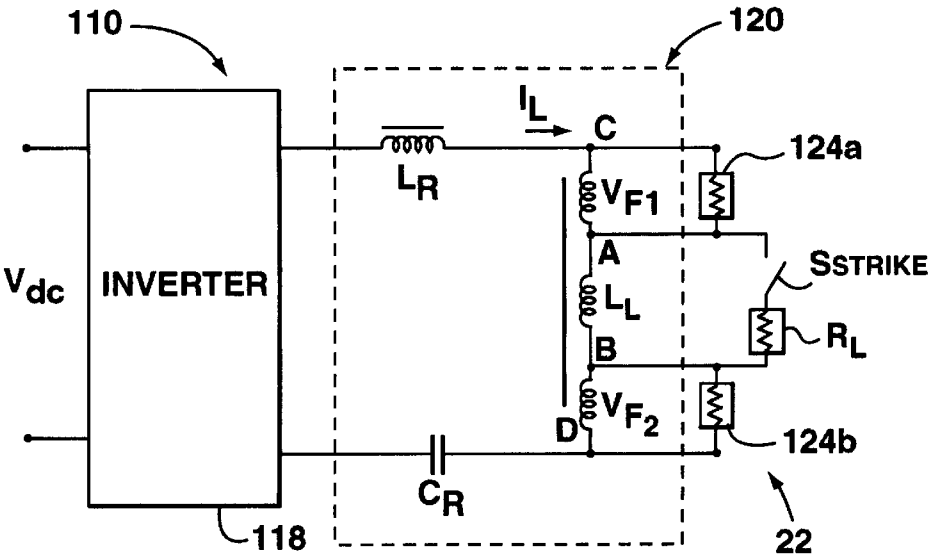
FIG. 8 is a schematic view of an equivalent electrical circuit for the resonance circuit and lamp according to the present invention.
Figure 10:
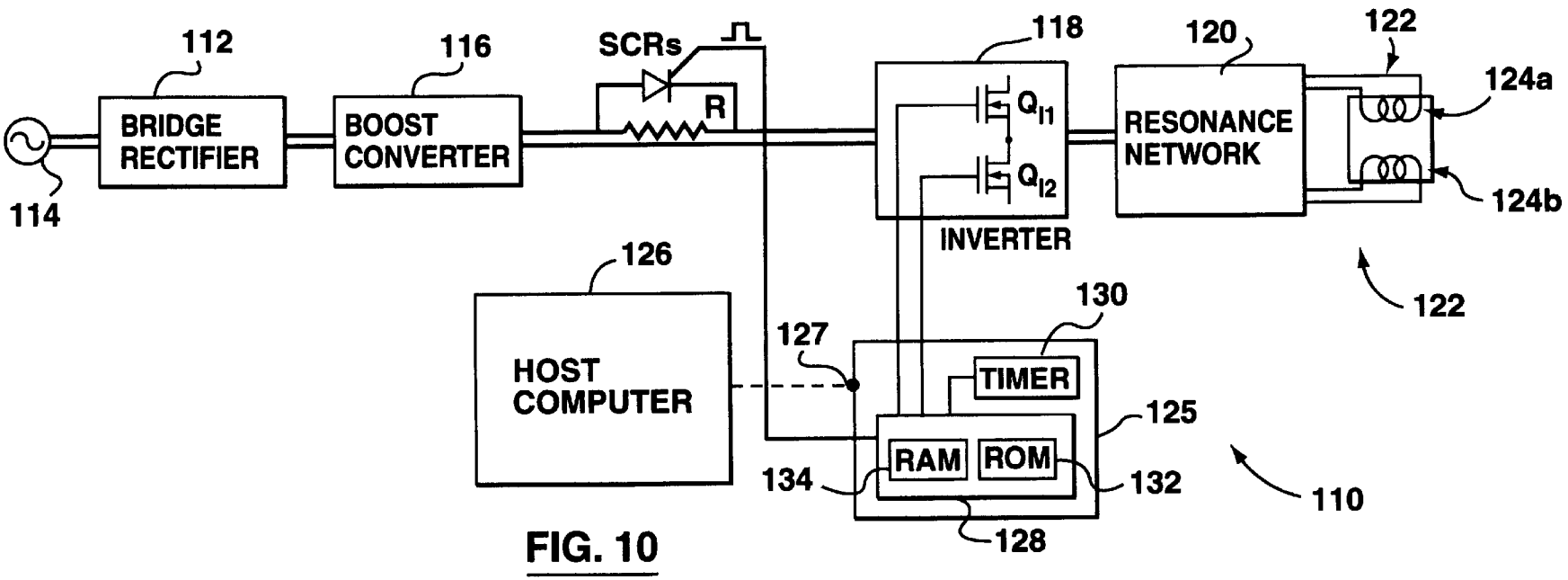
FIG. 10 is a schematic of the universal electronic lighting ballast of FIG. 7 including a simple starting circuit according to the present invention.

FIG. 10 shows a simple schematic of an alternative starting circuit which may be incorporated within universal ballast 110 of FIGS. 7 and 8 or within prior art ballasts such as those of FIGS. 1 and 2. A resistor R is coupled to the output of boost converter 116 and a thyristor $SCR_S$ is used to short resistor R. Start routine of controller 125 then provides thyristor $SCR_S$ with a pulse which will short resistor R and create a surge voltage sufficient to start the lamp. The timing of the SCR pulse can be controlled by controller 125 in a precise manner such that the filament is preheated for exactly 0.5 seconds. If desired, feedback from the filaments to controller 125 can be provided to indicate when the filaments are preheated.

The starting circuit of FIG. 10 provides superior lamp starting performance to other conventional methods since it uses a switchable resistive element in series with inverter 118 which can be precisely controlled by controller 125. In contrast, the accuracy of a "self timing" starting circuit, which typically uses a bimetal PTC element connected in parallel with the lamp, depends on the unreliable thermal/mechanical properties of the bimetal PTC element.

It should be noted that in FIG. 10, the switching and resistive elements are placed between boost converter 116 and inverter 118. However, alternatively an analogous device, such as a bidirectional switching device (e.g. a triac) in parallel with an impedance (usually a resistance) can be placed in series between inverter 118 and resonance network 120. This arrangement would provide a low amplitude AC signal to preheat the filaments while not striking lamp 22, then as before, the amplitude of the AC signal can be increased (by shorting the impedance) to strike lamp 22. However, this method is less desirable than that of FIG. 10 since damaging large voltage spikes may result from coupling such a device to the inductor LR of resonance network 120.

Yet another method for starting lamp 22 is available using universal ballast 110 as shown in FIG. 8, where the key feature is that capacitor $C_F$ has been replaced with inductors $L_{F1}$, $L_{F2}$ and $L_L$ as described above. In this circuit it is clear that filament voltage $V_F$'s relationship to frequency is opposite to their relationship when capacitor $C_F$ was present in the circuit. Accordingly, as inverter frequency is increased, filament voltage $V_F$ decreases. Increasing inverter frequency also increases inductive character which in turn reduces lamp current $I_L$ to filaments 124*a* and 124*b*.

The inventor has determined that by choosing the appropriate inductor values for $L_{F1}$, $L_{F2}$ and $L_L$, high frequency applied to lamp 22 will not start lamp 22 for 0.5 seconds as these inductances are accumulating energy. By experiment, it has also been determined that when a total inductance of 1H is used within universal ballast 110, lamp current flowing through lamp 22 is reduced and almost all current flows through inductors $L_{F1}$, $L_{F2}$ and $L_L$ for approximately 0.5 seconds. After the inductors $L_{F1}$, $L_{F2}$ and $L_L$ have sufficiently charged, current is suddenly available to the lamp and the lamp is started. Accordingly, it is possible to use inductances $L_{F1}$, $L_{F2}$ and $L_L$ such that lamp 22 will start automatically. When different lamps are inserted into the ballast, the starting conditions will of course change. In order to compensate for this, it will be necessary to program controller 125 to adjust the duty cycle and frequency of oscillating signal accordingly.

Using the configuration of FIG. 8 with the controller 125 and host computer 126 of FIG. 7, universal ballast 110 can also be used to provide substantially improved dimming limits. It has been experimentally determined that universal ballast 110 can achieve dimming of lamp 22 to 1% of light output by changing duty cycle and keeping frequency constant. It appears that by replacing capacitor $C_F$ by inductors $L_{F1}$, $L_{F2}$ and $L_L$, a significant change in behaviour of the lamp plasma occurs.

Although the exact rationale behind this phenomenon is not completely known, the inventor believes that the lamp may be acting as a very low value capacitor. Since in a conventional circuit capacitor $C_F$ is connected in parallel across lamp 22, current will flow in the larger capacitor of the two, or capacitor $C_F$. If frequency is increased (as has been typically done in conventional dimming circuits) capacitor $C_F$ will draw most of the current. As a result, lamp 22 will experience close to zero current and the plasma thread will break. It appears that through the use of inductors $L_{F1}$, $L_{F2}$ and $L_L$, an opposite effect takes place (i.e. the inductors present a higher impedance to the high frequency components of the low duty cycle AC signal) and the plasma trace can be retained down to a very low level of lamp power.

By appropriately programming universal ballast 110, various market available dimming protocols may be implemented. The well known "0 to 10 V" signalling protocol uses a pair of dedicated wires to send a dimming control signal represented by a voltage signal of value between 0 and 10 volts to the ballast dimming circuitry. Controller 125 of universal ballast 110 can then convert this control signal into a signal adapted to change ballast operating conditions as has been discussed.

Further, the digital protocol method developed by Tridonic Corporation uses signal wires to transmit digital information representing the desired brightness level (i.e., 128 or 256 levels of brightness) and other information such as the particular address of the target ballast to be dimmed. This dimming protocol can be implemented by storing and utilizing an appropriate dimming table within ROM 132 of controller 125.

Finally, it is also possible to control the output voltage of boost converter 116. By changing the duty cycle of inverter 118 signal and keeping frequency constant, the output voltage $V_{OUT}$ of boost converter 116 can be regulated according to the relation:

$$V_{OUT} = \frac{V_{IN}}{(1-D)}$$

where $V_{IN}$ is the input voltage of boost converter 116 and D is the duty cycle of the inverter signal.

In use, once a user determines that a particular lamp is to be accommodated by universal ballast 110, application software is run on host computer 126 to determine which program shown be installed within ballast 110. Once this program has been prepared, host computer 126 will download it through port 127 to microprocessor 128. Universal ballast 100 will then be operational and will begin changing the frequency and duty cycle of the inverter signal according to its built-in routines to provide appropriate lamp operating characteristics and conditions. The user will then remove universal ballast 110 from host computer 112 and proceed to operate universal ballast 100. When the user presses the appropriate button for striking, microprocessor 128 will call the start routine which will strike lamp 22. Once lamp 22 has been successfully struck, the running routine will be executed to maintain lamp 22 in proper running condition. When the user presses the appropriate button for dimming, microprocessor 128 will call the dimming routine during which controller 125 will implement a variety of dimming protocols.

Thus, the universal ballast can be programmed to accommodate a wide range of gas discharge lamp types. By using the experimentally determined relationship between changes in inverter signal frequency and duty cycle and resonance voltage and currents, the present invention efficiently and accurately matches each lamp's unique starting, operating and dimming characteristics and requirements. Further, the use of a simple inductive element in parallel with the lamp provides a extremely cost and space effective dimming capability. In contrast to industry wide dimming rates of 25% of total light output for linear lamps and 10% for compact lamps, the present invention may provide dimming performance down to as little as 1% of total light output. In this regard, the universal ballast is extremely cost efficient, especially when contrasted with the complex dimming circuitry commonly associated with gas discharge ballasts. The use of this inductive element also results in a simplified and reliable lamp striking procedure.

As will be apparent to persons skilled in the art, various modifications and adaptations of the structure described above are possible without departure from the present invention, the scope of which is defined in the appended claims.

I claim:

1. A universal lamp system comprising:

(a) a lamp having a predetermined set of lamp operating characteristics, said operating characteristics including a lamp running voltage and a filament voltage, said lamp running voltage having a value between a first value and a second value and said lamp filament voltage having a value between a third value and a fourth value;

(b) a universal ballast having:

(i) a first power circuit for outputting a high frequency AC signal;

(ii) a coupling circuit coupled to the power circuit for applying the AC signal to the lamp to provide said lamp running voltage and said filament voltage at said lamp; and (iii) a control circuit adapted to vary the duty cycle of the AC signal in a range of between about a 50/50 ratio and about a 2/98 ratio and the frequency of the AC signal in a range of between about 20 and about at least 47 kilohertz but not greater than about 55 kilohertz and therefore to vary said lamp running voltage between said first and second values and said filament voltage between said third and fourth values, said first and second values having a difference between them of about 77 percent and said third and fourth values having a difference between them of about 58 percent.

2. The universal lamp system of claim 1 wherein the AC signal is a square wave.

3. The universal lamp system of claim 1 wherein the control circuit includes a controller and a host computer.

4. The universal lamp system of claim 3 wherein said controller includes a microprocessor having a memory.

5. The universal lamp system of claim 3 wherein said host computer is connected to the controller through a port such that a program can be downloaded to the controller to appropriately vary the frequency and duty cycle of the AC signal in accordance with the set of lamp characteristics.

6. The universal lamp system of claim 1, 2, 3, 4 or 5 wherein the coupling circuit includes a capacitor and an inductor in series with the lamp.

7. The universal lamp system of claim 1, 2, 3, 4 or 5 wherein the coupling circuit includes an inductive element across the lamp.

8. The universal lamp system of claim 1, 2, 3, 4, or 5 wherein the lamp has two filaments and wherein three inductors are connected in series across the lamp such that one inductor is connected across each filament.

9. The universal lamp system of claim 1, 2, 3, 4, or 5 wherein the lamp has two filaments and wherein a three winding inductor is connected across the lamp such that a winding is connected across each filament.

10. The universal lamp system according to claim 1, wherein the universal ballast includes an impedance in series with the first power circuit for limiting the current supplied thereto and a controllable switch connected across the impedance, said switch having open and closed states so that when the switch is in the open state the impedance limits the current to the first power circuit, and when the switch is in the closed state current to the first power circuit is not limited by said impedance, and wherein said control circuit is coupled to the controllable switch for maintaining the switch in the open state for a predetermined period of time after the lamp is started and then closing the switch.

11. The lamp system according to claim 10 wherein the circuit includes a second power circuit in series with the first power circuit for supplying a DC voltage to the first power circuit and wherein the impedance comprises a resistance coupled in series between first and second power circuits.

12. The lamp system according to claim 11 wherein the controller includes a microprocessor having a memory.

13. The lamp system according to any one of claims 10, 11 and 12 wherein the lamp includes at least one filament and wherein the current provided by the first power circuit when the switch in the open state is insufficient to strike the lamp but sufficient to preheat the at least one filament when applied for the predetermined period of time.

14. A method of powering any one of a plurality of gas discharge lamp types, each lamp type having a predetermined set of lamp operating characteristics, said method comprising the steps of:

(a) producing a high frequency AC signal;

(b) applying the AC signal to the lamp; and (c) varying the duty cycle of the AC signal within the range of from about a 50/50 ratio to about a 2/98 ratio and the frequency of the AC signal within the range of from about 20 to about at least 47 kilohertz but not greater than about 55 kilohertz such that the predetermined set of lamp operating characteristics are produced.

15. The method of claim 14 and including storing information about the lamp characteristics in a microprocessor having memory and using said microprocessor to control the step of varying the duty cycle and frequency of the AC signal.

16. A method of dimming a gas discharge lamp, comprising:

(a) establishing an inductance across the lamp;

(b) producing a high frequency AC signal;

(c) applying the AC signal to the lamp;

(d) varying the duty cycle of the AC signal within a range of from about a 50/50 ratio to about a 2/98 ratio and the frequency of the AC signal within the range of from about 20 to at least about 47 kilohertz but not greater than about 55 kilohertz to dim the lamp.

* * * * *